US012622494B2

(12) United States Patent
Guo et al.

(10) Patent No.: US 12,622,494 B2
(45) Date of Patent: May 12, 2026

(54) ZIPPER STRUCTURE, CASE BODY, MOLD FOR MANUFACTURING CASE BODY, AND MOLD OPERATION METHOD

(71) Applicant: CHUZHOU YUJIAN TRAVEL PRODUCT CO., LTD., Chuzhou City (CN)

(72) Inventors: Changjun Guo, Chuzhou City (CN); Changyong Huang, Chuzhou City (CN)

(73) Assignee: CHUZHOU YUJIAN TRAVEL PRODUCT CO., LTD., Chuzhou City (CN)

( * ) Notice: Subject to any disclaimer, the term of this patent is extended or adjusted under 35 U.S.C. 154(b) by 134 days.

(21) Appl. No.: 18/619,333

(22) Filed: Mar. 28, 2024

(65) Prior Publication Data

US 2025/0213013 A1 Jul. 3, 2025

(30) Foreign Application Priority Data

Dec. 29, 2023 (CN) ..... 202311870755.2
Dec. 29, 2023 (CN) ..... 202311870916.8

(51) Int. Cl.
*A44B 19/26* (2006.01)

(52) U.S. Cl.
CPC ..... *A44B 19/26* (2013.01)

(58) Field of Classification Search
CPC ..... A44B 19/26; B29C 2045/0093; B29C 51/10; A45C 13/103
See application file for complete search history.

(56) References Cited

U.S. PATENT DOCUMENTS

2008/0229552 A1* 9/2008 Martin ..... A63H 27/08 24/381

* cited by examiner

*Primary Examiner* — David M Upchurch

(57) ABSTRACT

A zipper structure, a case body, a mold for manufacturing a case body, and a mold operation method. The zipper structure is for connecting an upper housing and a lower housing of a case body. The zipper structure includes two zipper bodies, each zipper body including a zipper fabric and a keel; an end of the zipper fabric is arranged with first zipper teeth, and the other end of the zipper fabric is configured to be connected to a lining fabric of the case body; the first zipper teeth of one of the two zipper bodies are configured to be engaged with the first zipper teeth of the other of the two zipper bodies; the keel is connected to the zipper fabric; each zipper body is fixed to the case body by fixedly connecting the keel to the case body.

15 Claims, 8 Drawing Sheets

ZIPPER STRUCTURE, CASE BODY, MOLD FOR MANUFACTURING CASE BODY, AND MOLD OPERATION METHOD

CROSS REFERENCE

The present disclosure claims priority of Chinese Patent Application No. 202311870755.2, filed on Dec. 29, 2023, and No. 202311870916.8, filed on Dec. 29, 2023, the entire contents of which are hereby incorporated by reference in their entirety.

TECHNICAL FIELD

The present disclosure relates to field of luggage technologies, and more specifically to a zipper structure, a case body, a mold for manufacturing a case body, and a mold operation method.

BACKGROUND

Currently, trolley cases on the market can be roughly divided into two types, one being a zipper case (i.e., with a zipper to control the opening and closing of the case), and the other being a snap-lock case (i.e., with a snap-lock mechanism to control the opening and closing of the case). Since the zipper case has a larger capacity and a lighter weight, it is more convenient to use and thus more widely applied. Therefore, the zipper case occupies a dominant position in the luggage market. In the production of existing zipper cases, the zipper and the case housing are fixed together through lathe stitching by a stitcher (commonly known as: stitching machine) almost always by manual means. This production means using manual stitching requires a high level of proficiency in employee skills, which leads to problems of high defective rates, low efficiency, and high labor costs. As the competition in the manufacturing industry is getting bigger and bigger, luggage enterprises are facing industrial upgrading. When the enterprises continue to adopt this traditional zipper assembly method, they will surely lose the competitive advantage in the industry, and it is difficult for the enterprises to go farther.

Moreover, the traditional zipper structure is together with a leather strip, which is stitched on the case body (housing) by manual stitching. The stitching line of the zipper is under the leather strip. The specific operation sequence is: first bonding a lining fabric and the case, and then lathe stitching the leather strip together with the zipper on the case body, which is time-consuming and must be completed by very experienced masters of stitchers. Further, manual operation of the stitchers has higher labor costs. In addition, after the traditional zipper is assembled to the case body, the leather strip or frame may be higher than the case body about 2-5 mm, affecting the overall beauty of the case body. Moreover, the traditional zipper case is straight-sided at an opening of the case, such that the opening is less strong and easy to deform.

SUMMARY OF THE DISCLOSURE

In order to mitigate the problems of an existing zipper case, where the production cost is high, the leather strip or frame will be higher than the case body after assembly, the opening of the case body has a poor strength, the installation is required with fully manual stitching, the defective rate is high, and the labor cost is high, the present disclosure provides the following technical solutions.

A zipper structure for connecting an upper housing and a lower housing of a case body; wherein the zipper structure includes two zipper bodies, each zipper body including a zipper fabric and a keel; an end of the zipper fabric is arranged with first zipper teeth, and the other end of the zipper fabric is configured to be connected to a lining fabric of the case body; the first zipper teeth of one of the two zipper bodies are configured to be engaged with the first zipper teeth of the other of the two zipper bodies; the keel is connected to the zipper fabric; each zipper body is fixed to the case body by fixedly connecting the keel to the case body.

In some embodiments, the other end of the zipper fabric, is arranged with second zipper teeth to be engaged with the lining fabric, and the keel is arranged between the first zipper teeth and the second zipper teeth.

In some embodiments, the zipper fabric includes two portions, and the keel is configured to connect the two portions; an end of the two portions away from keel is arranged with the first zipper teeth.

In some embodiments, the keel and the zipper fabric are in a one-piece structure; or, the keel is fixed to the fabric through a lathe stitching or an adhesive.

In some embodiments, the keel is of a one-piece hollow type.

In some embodiments, the keel is a segmented keel including a plurality of segments, in a chain shape, a snap shape, or a pleated shape.

In some embodiments, the keel is configured to be arranged on an outer periphery of the case body and is fixed to the case body by means of a fastener or an adhesive.

In some embodiments, the zipper fabric has elasticity.

A case body, including two housings and a zipper structure for connecting the two housings; wherein the zipper structure includes two zipper fabrics and two keels; for each of the two keels: the keel is fixedly connected to a corresponding zipper fabric; and the corresponding zipper fabric is arranged on a corresponding housing; the corresponding zipper fabric is arranged with first zipper teeth, for controlling an opening and closing of the corresponding housing; the corresponding housing defines a recess for accommodating the keel; the keel is fixed within the recess for fixing the corresponding zipper fabric to the corresponding housing.

In some embodiments, a decorative strip is arranged at an opening of the recess to cover the keel, and an outer peripheral surface of the decorative strip is flush with an outer surface of the case body.

In some embodiments, the decorative strip is arranged with a first snap portion and the keel is arranged with a second snap portion; the decorative strip is fastened by snapping the first snap portion to the second snap portion.

In some embodiments, wherein the keel is fixed to the recess by means of an adhesive or a fastener.

In some embodiments, the keel is made of plastic, soft rubber, wood, metal, or leather.

In some embodiments, an inner wall surface of the recess is adapted to an outer wall surface of the keel.

In some embodiments, an end of the corresponding zipper fabric is arranged with the first zipper teeth, and the other end of the corresponding zipper fabric is arranged with second zipper teeth; the first zipper teeth are exposed from the case body and configured to be engaged with the first zipper teeth on the other of the two zipper fabrics; the second zipper teeth are configured to be engaged with third zipper teeth on a lining fabric inside the case body.

A mold, including a mold body and movable members; wherein the mold body is arranged with a first molding portion, and each movable member is arranged with a second molding portion; the movable members are disposed along a periphery of the first molding portion; a heated sheet is attracted by a vacuum so as to attract the heated sheet to form a housing on a surface of the first molding portion, and a recess is defined by means of the second molding portion; wherein the housing is applied to a case body; the case body includes two the housings and a zipper structure for connecting the two housings; wherein the zipper structure includes two zipper fabrics and two keels; for each of the two keels: the keel is fixedly connected to a corresponding zipper fabric; and the corresponding zipper fabric is arranged on a corresponding housing; the corresponding zipper fabric is arranged with first zipper teeth, for controlling an opening and closing of the corresponding housing; the corresponding housing defines a recess for accommodating the keel; the keel is fixed within the recess for fixing the corresponding zipper fabric to the corresponding housing.

An operation method of the mold, including: (1) gathering the movable members disposed around an upper part of the mold body in a horizontal direction towards a center; wherein the number of the movable members is four; (2) placing the heated sheet on the mold body; (3) attracting the heated sheet by vacuum, such that the heated sheet is attracted downwardly on the first molding portion of the mold body to form a body of the housing; and defining the recesses on the second molding portions of the movable members; (4) during a demolding process, moving the movable members outwardly in the horizontal direction away from the center; and sinking the mold body downwardly to separate the housing from the mold body; and (5) removing the housing.

An operation method of the mold, including: (1) placing the movable members into assembly slots around an upper part of the mold body; wherein the number of the movable members is four; (2) placing the heated sheet on the mold body; (3) attracting the heated sheet by vacuum, such that the heated sheet is attracted downwardly on the first molding portion of the mold body to form a body of the housing; and defining the recesses on the second molding portions of the movable members; and (4) during a demolding process, simultaneously releasing the movable members upwardly along with the housing to separate from the mold body; moving the movable members out in a lateral direction.

By virtue of the above technical solutions, the present disclosure can achieve the following technical effects.

1. In the embodiments, the keel is fixed to the case body in order to fix the zipper body to the case body. There is no need for manual lathe stitching through a stitcher during the fixing of the zipper body, thereby reducing labor costs. In addition, the keel can be fixed by assembling, and its operation difficulty is much less than the operation difficulty of lathe stitching through the stitcher, which may guarantee the assembly quality and thus improve the yield rate. In addition, it is easy to realize automatic production by assembling and fixing the keel, which solves the problem of the traditional production line not being able to be automated. The modularization of the zipper structure and automated assembly production may optimize factory material management and production line staffing, such that production efficiency and production quality may be greatly improved, and the factory's labor costs and production costs may be greatly saved, thereby achieving cost reduction and efficiency increasing.
2. The zipper fabric and the keel form a modular assembly, and the zipper teeth that engage with the inner lining are reserved internally, which facilitates the installation and disassembly of the lining fabric as well as the cleaning or washing of the lining fabric, thereby facilitating the use by consumers.
3. The zipper fabric has elasticity. Through the elasticity generated by the zipper fabric itself, the expansion function of the zipper case is realized.
4. In the embodiments, the keel is fixed to the case body in order to fix the zipper body to the case body. There is no need for manual lathe stitching through a stitcher during the fixing of the zipper body, thereby reducing labor costs. In addition, the keel can be fixed by assembling, and its operation difficulty is much less than the operation difficulty of lathe stitching through the stitcher, which may guarantee the assembly quality and thus improve the yield rate. In addition, it is easy to realize automatic production by assembling and fixing the keel, which solves the problem of the traditional production line not being able to be automated. The modularization of the zipper structure and automated assembly production may optimize factory material management and production line staffing, such that production efficiency and production quality may be greatly improved, and the factory's labor costs and production costs may be greatly saved, thereby achieving cost reduction and efficiency increasing. Further, the keel 3 is arranged within the recess, so as to make the height of the keel lower than a peripheral surface of the case body, enabling the case body to have an integrated appearance and thus enhancing the overall effect and aesthetics of the case body. In addition, the provision of the recess may enhance the strength of the opening of the case body, and the connection of the keel and the recess may further enhance the strength of the case body, thereby mitigating a problem of a weak strength of the case body due to the fact that the existing zipper case has a straight-sided surface near the opening.

BRIEF DESCRIPTION OF THE DRAWINGS

In order to more clearly illustrate the technical solutions of the embodiments of the present disclosure, the accompanying drawings to be used in the embodiments will be briefly introduced below, and it should be understood that the following accompanying drawings only show certain embodiments of the present disclosure, and therefore should not be regarded as a limitation thereof. For those skilled in the art, other relevant accompanying drawings can be obtained based on the drawings, without creative labor.

REFERENCE NUMERALS

1—case body; 11—upper housing; 12—lower housing; 13—lining fabric; 131—third zipper teeth; 14—recess;
2—zipper fabric; 21—first zipper teeth; 22—second zipper teeth;
3—keel; 31—adhesive strip;
4—rivet;
5—decorative strip;
6—mold body; 61—first molding portion;
7—movable member; 71—second molding portion;
8—sheet.

DETAILED DESCRIPTION

In order to make the objects, technical solutions, and advantages of the embodiments of the present disclosure clearer, the technical solutions in the embodiments of the present disclosure will be described clearly and completely in the following in conjunction with the accompanying drawings in the embodiments of the present disclosure. It is clear that the embodiments described are a part of the embodiments of the present disclosure and not all of the embodiments. Accordingly, the following detailed description of the embodiments of the present disclosure provided with the accompanying drawings is not intended to limit the scope of the present disclosure, but rather represents only selected embodiments of the present disclosure. Based on the embodiments in the present disclosure, all other embodiments obtained by those skilled in the art without creative labor fall within the scope of the present disclosure.

Embodiments

Figure 1:
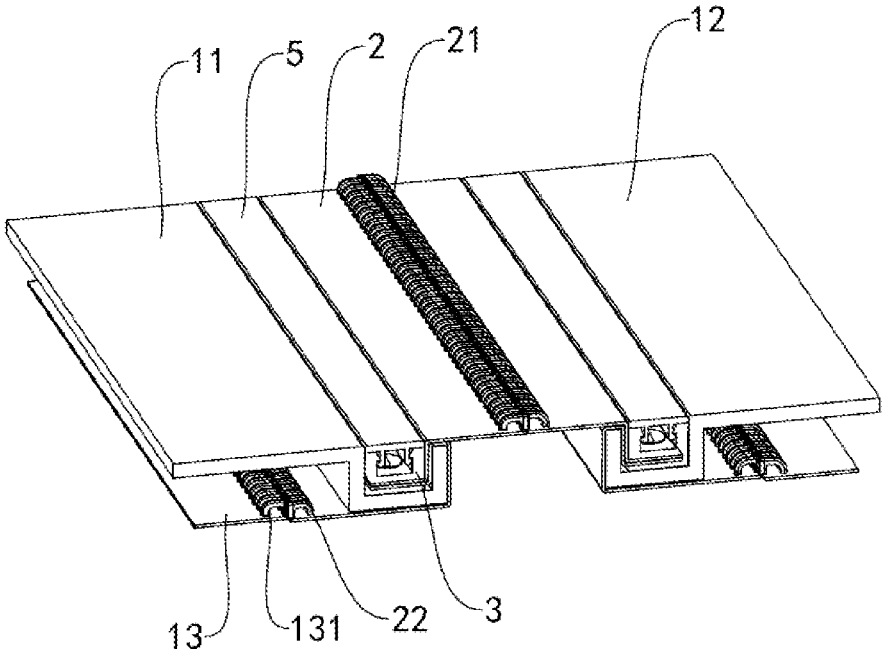
FIG. 1 is a structural schematic view according to some embodiments of the present disclosure.
Figure 2:
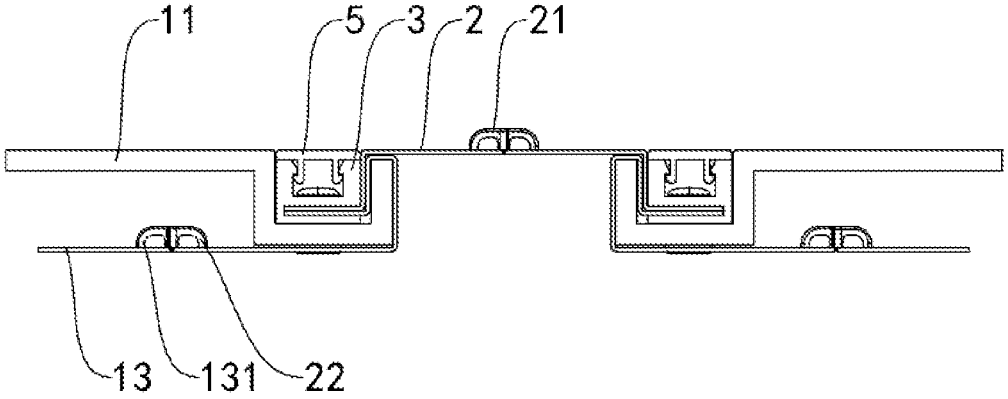
FIG. 2 is a structural schematic view according to some embodiments of the present disclosure at another viewing angle.

Referring to FIGS. 1 and 2, the present disclosure provides a zipper structure for connecting an upper housing 11 and a lower housing 12 of a case body 1; the zipper structure includes two zipper bodies, each zipper body including a zipper fabric 2 and a keel 3; an end of the zipper fabric 2 is arranged with first zipper teeth 21, and the other end of the zipper fabric 2 is configured to be connected to a lining fabric 13 of the case body 1; where the first zipper teeth 21 are exposed from the case body 1 and are configured to be engaged with the first zipper teeth 21 of the other zipper body; the keel 3 is connected to the zipper fabric 2, and thus the zipper body is fixed to the case body 1 by fixedly connecting the keel 3 to the case body 1. In some embodiments, the keel 3 is configured to be arranged on an outer periphery of the case body 1 and is fixed to the case body 1 by means of a fastener or adhesive. Exemplarily, the keel 3 may be fixed to the case body 1 by means of a rivet 4 (spigot) fixing, screw fixing, glue fixing, heat fusing, lathe stitching, etc.

It is to be noted that in the embodiments, the keel 3 is fixed to the case body 1 in order to fix the zipper body to the case body 1. There is no need for manual lathe stitching through a stitcher during the fixing of the zipper body, thereby reducing labor costs. In addition, the keel 3 can be fixed by assembling, and its operation difficulty is much less than the operation difficulty of lathe stitching through the stitcher, which may guarantee the assembly quality and thus improve the yield rate. In addition, it is easy to realize automatic production by assembling and fixing the keel 3, which solves the problem of the traditional production line not being able to be automated. The modularization of the zipper structure and automated assembly production may optimize factory material management and production line staffing, such that production efficiency and production quality may be greatly improved, and the factory's labor costs and production costs may be greatly saved, thereby achieving cost reduction and efficiency increasing.

On the basis of the above embodiments, in some embodiments, the other end of the zipper fabric 2, that is opposite to the end with the first zipper teeth 21, is arranged with second zipper teeth 22 to be engaged with the lining fabric 13, and the keel 3 is arranged between the first zipper teeth 21 and the second zipper teeth 22. Exemplarily, a whole sheet of the zipper fabric 2 is applied, followed by being bent and stitched according to a desired size, and a bending position is configured to be connected to the keel 3. In other embodiments, two pieces of the zipper fabric 2 are applied to be spliced and stitched, and a bending position of the two pieces of the zipper fabric is configured to be connected to the keel 3; the end of the zipper fabric 2 away from the keel 3 is configured with the first zipper teeth 21 to be engaged with the other zipper body, and the other end of the zipper fabric 2 is to be engaged with the lining fabric 13. For a traditional zipper case, its lining fabric, zipper, and case body are required to be manually stitched to become a whole and cannot be disassembled. In the present embodiments, the zipper fabric 2 and the keel 3 form a modular assembly, and the zipper teeth that engage with the inner lining are reserved internally, which facilitates the installation and disassembly of the lining fabric 13 as well as the cleaning or washing of the lining fabric 13, thereby facilitating the use by consumers.

Figure 3:
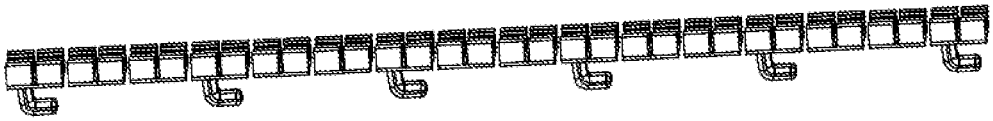
FIG. 3 is a structural schematic view of a keel according to some embodiments of the present disclosure.
Figure 4:
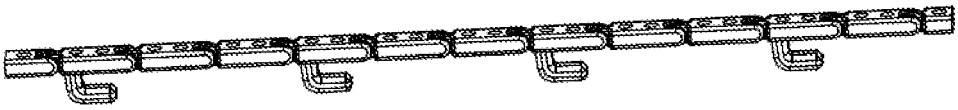
FIG. 4 is a structural schematic view of a keel according to other embodiments of the present disclosure.
Figure 5:
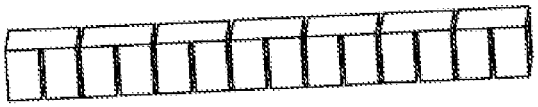
FIG. 5 is a structural schematic view of a keel according to further other embodiments of the present disclosure.
Figure 6:
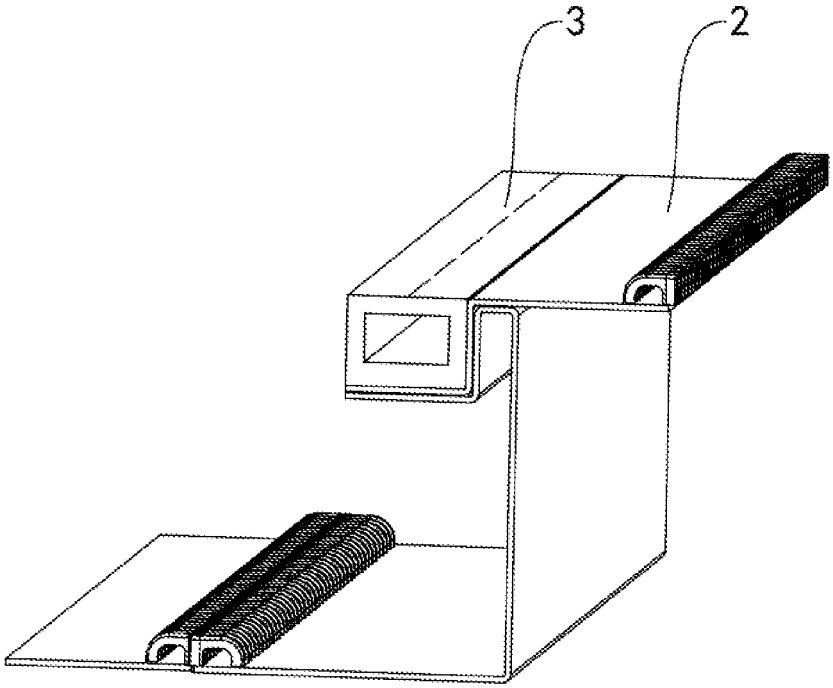
FIG. 6 is a structural schematic view of a keel being stitching-connected to a zipper fabric according to some embodiments of the present disclosure (in which broken lines indicate stitching tracks).
Figure 7:
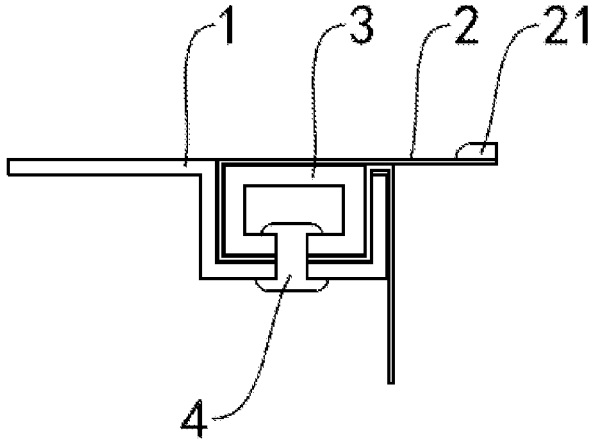
FIG. 7 is a schematic view of an assembly of a zipper structure according to some embodiments of the present disclosure.
Figure 8:
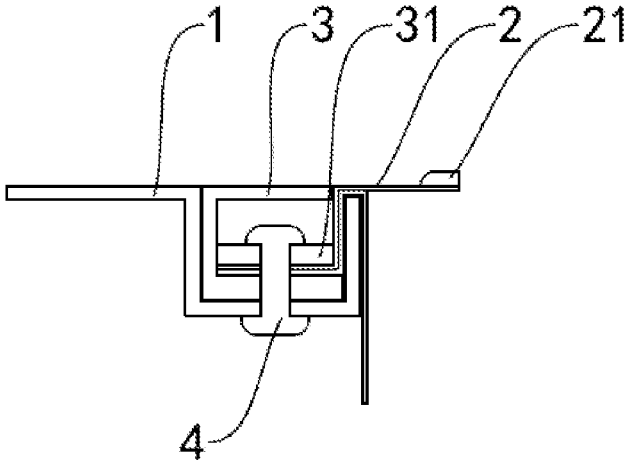
FIG. 8 is a schematic view of an assembly of a zipper structure according to other embodiments of the present disclosure.
Figure 9:
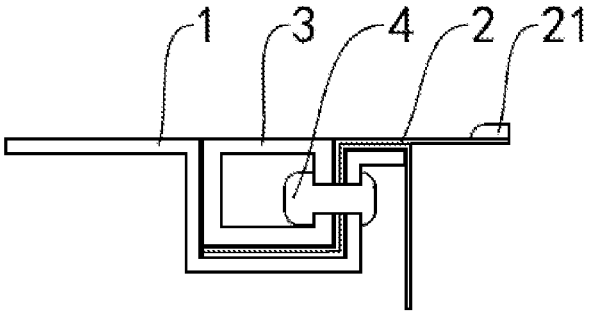
FIG. 9 is a schematic view of an assembly of a zipper structure according to further other embodiments of the present disclosure.
Figure 10:
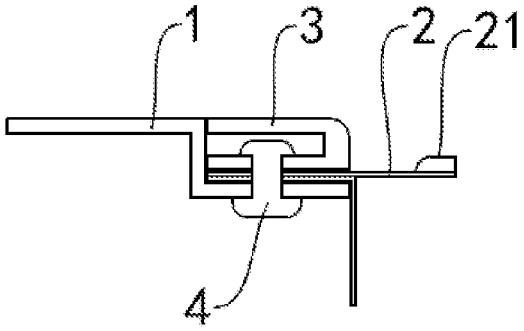
FIG. 10 is a schematic view of an assembly of a zipper structure according to still other embodiments of the present disclosure.
Figure 11:
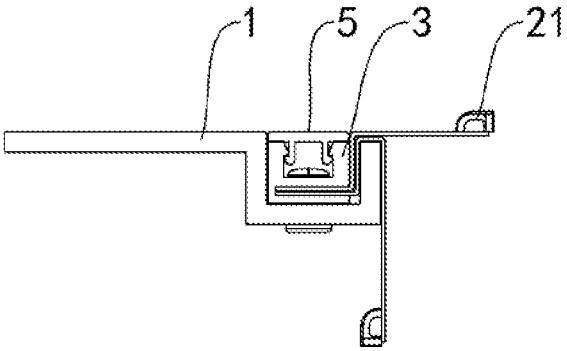
FIG. 11 is a structural schematic view of a case body according to some embodiments of the present disclosure.
Figure 12:
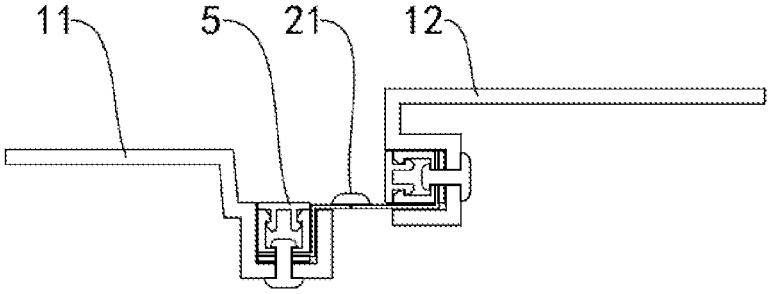
FIG. 12 is a structural schematic view of a case body according to other embodiments of the present disclosure.

In some embodiments, the keel 3 and the zipper fabric 2 are in a one-piece structure, such as, twice-encapsulation injection molding, which is not limited in the present disclosure. In other embodiments, the keel 3 and the zipper fabric 2 may be fixed by lathe stitching (as shown in FIG. 6), heat fusion, rivets 4, snaps, buckles, adhesive, etc. In some embodiments, the keel 3 and the zipper fabric 2 are integrally injection molded, which has a higher bonding strength; the keel 3 is a monolithic or segmented keel, where the monolithic keel is a whole section of an independent keel, and the segmented keel is a keel including a plurality of segments; the keel 3 can be bent along with the shape of the case body and thus can coincide with any curvature of the circumference of the case body 1. The length of the keel 3 can be adjusted by the number of the segments, and the length of each segment can be set according to needs. In conjunction with FIGS. 3 to 5, the keel 3 may be in a chain shape, a snap shape, or a pleated shape, etc. The keel 3 may be made of plastic, soft rubber, wood, metal, leather, etc. In other embodiments, the keel 3 is a one-piece hollow type, where the keel 3 may be formed by whole hollow extrusion molding or metal bending molding; the keel 3 may be made of metal, soft rubber, hard rubber, soft and hard co-extruded material, or wood, i.e., the material can be selective with good strength. In this way, the keel 3 and the zipper can be one-piece adapted to any circumferential curvature of the case body 1. Combined with FIGS. 7 to 10, the keel 3 may be in different shapes, and an adhesive strip may be padded at a locking position of the keel 3 to enhance the fastening of the locking position; the adhesive strip 31 may be made of hard or soft rubber or a combination of the two; the fixed rivet 4 may be arranged on a bottom surface or a side surface of the keel 3. That is, the specific form as well as the shape of the keel 3 are diversified, which may satisfy different design needs of the case body 1.

Further, the zipper fabric 2 has elasticity. Through the elasticity generated by the zipper fabric 2 itself, the expansion function of the zipper case is realized, and the capacity of the case body 1 can be expanded by more than 20%, which is more concise, convenient, and practical than the zipper expansion function of the traditional zipper case. Recycled mineral water bottles may be applied as raw materials, followed by being processed and produced into a new type of environmentally friendly material, which is woven into the zipper fabric 2 with elasticity. It can be understood that the zipper fabric 2 may made of other fabrics with elasticity. The zipper fabric 2 can be applied to a variety of forms of zipper cases, such as those with a front-opening lid, back-opening lid, side-opening lid, top-opening lid, external pocket, or external backpack, etc. The zipper case is a case that is adopted with a zipper for opening and closing, including a blister zipper case, an injection-molded zipper case, a frame zipper case, a hot-press molded zipper case, a fabric case, a cosmetic case, and the like, and is not limited thereto.

In conjunction with FIGS. 11 to 14, the present disclosure further provides a case including an upper housing 11 and a lower housing 12, the upper housing 11 and the lower housing 12 being connected to each other through a zipper structure. The zipper structure is the zipper structure as in any of the above embodiments. In some embodiments, an angular-shaped recess 14 is defined around an opening of the case. The recess 14 directly reinforces the opening, and the keel 3 is arranged in the recess 14 to improve the overall strength of the case body 1. During assembly, the keel 3 is snapped into the recess 14 and fixed to the recess 14 to fixedly connect the zipper structure to the case body 1. For example, the rivet 4 (spigot) is driven outwardly from an interior of the case body 1 to fix the keel 3. The keel 3 may be fixed to the recess 14 by screws, adhesive, heat fusion, lathe stitching, and the like.

Other embodiments provide a case body including two housings (i.e., an upper housing 11 and a lower housing 12) and a zipper structure for connecting the two housings, the zipper structure including two zipper fabrics 2 and a keel 3 fixedly connected to each of the two zipper fabrics 2; where each of the zipper fabrics 2 is arranged with first zipper teeth 21 for controlling an opening and closing of the two housings, and each of the housings defines a recess 14 for accommodating the keel 3; the keel 3 is fixed within the recess 14 to fix the zipper fabrics 2 to the housings.

Further, the height of the keel 3 is less than or equal to the depth of the recess 14, so as to make the height of the keel 3 lower than a peripheral surface of the case body 1, enabling the case body 1 to have an integrated appearance and thus enhancing the overall effect and aesthetics of the case body 1. In some embodiments, a decorative strip 5 is arranged to cover the keel 3 at an opening of the recess 14, and an outer peripheral surface of the decorative strip 5 is flush with the peripheral surface of the case body, so as to make the appearance of the case body 1 neater. In some embodiments, the decorative strip 5 is arranged with a first snap portion and the keel 3 is arranged with a second snap portion, and the decorative strip 5 is fastened by snapping the first snap portion to the second snap portion, where the first snap portion and the second snap portion may each be provided as a snap, which is not limited thereto.

Figure 13:
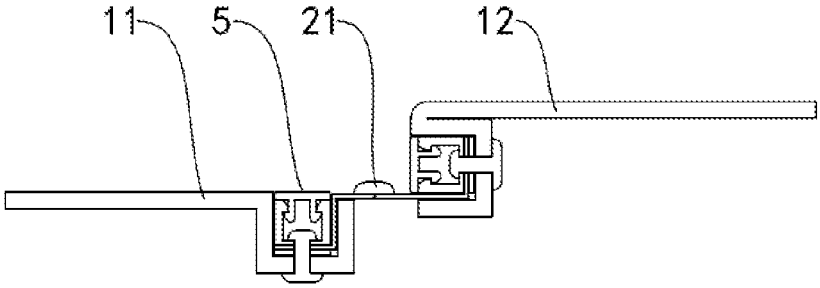
FIG. 13 is a structural schematic view of a case body according to further other embodiments of the present disclosure.
Figure 14:
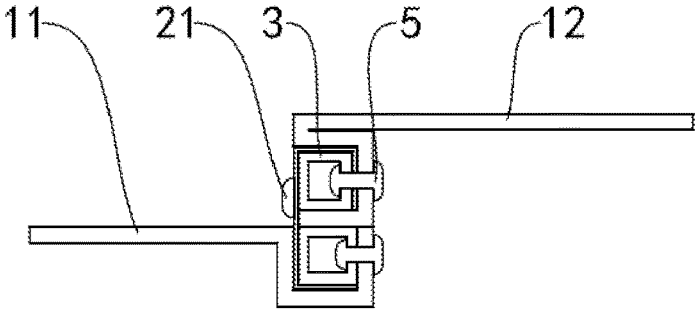
FIG. 14 is a structural schematic view of a case body according to still other embodiments of the present disclosure.
Figure 15:
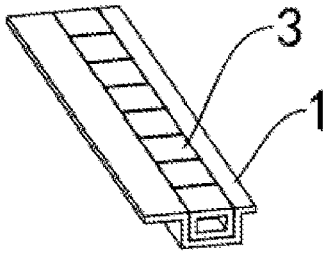
FIG. 15 is a structural schematic view of a recess being assembled to a keel according to some embodiments of the present disclosure.
Figure 16:
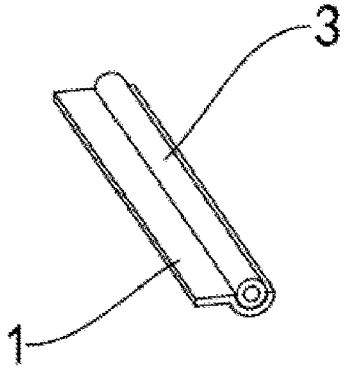
FIG. 16 is a structural schematic view of a recess being assembled to a keel according to other embodiments of the present disclosure.
Figure 17:
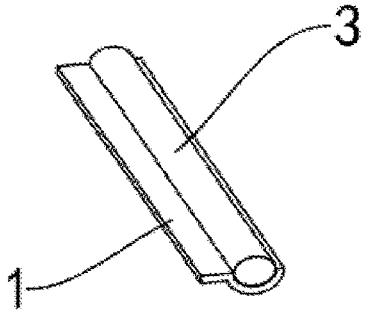
FIG. 17 is a structural schematic view of a recess being assembled to a keel according to further other embodiments of the present disclosure.
Figure 18:
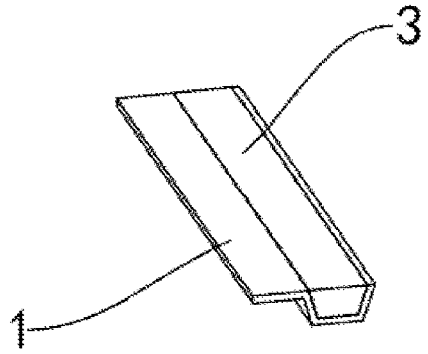
FIG. 18 is a structural schematic view of a recess being assembled to a keel according to still other embodiments of the present disclosure.
Figure 19:
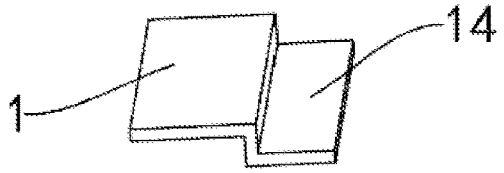
FIG. 19 is a structural schematic view of a recess according to some embodiments of the present disclosure.
Figure 20:
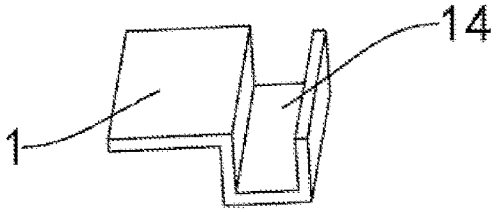
FIG. 20 is a structural schematic view of a recess according to other embodiments of the present disclosure.
Figure 21:
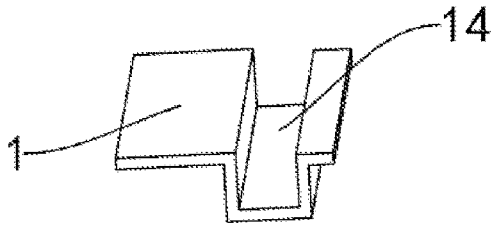
FIG. 21 is a structural schematic view of a recess according to further other embodiments of the present disclosure.
Figure 22:
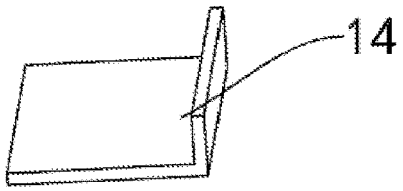
FIG. 22 is a structural schematic view of a recess according to still other embodiments of the present disclosure.
Figure 23:
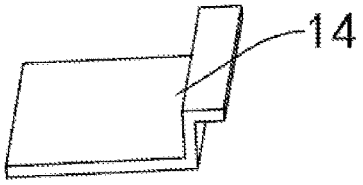
FIG. 23 is a structural schematic view of a recess according to still other embodiments of the present disclosure.

In the embodiments, referring to FIG. 13, the case body 1 does not show a step undulation as the traditional way of opening the lid, and the surfaces of the case body 1 is more flat, more integral, and more aesthetically pleasing. Referring to FIG. 14, the case body 1 does not have a circumferential large gap as the traditional way of opening the lid, which is more space-saving, and the case body 1 has a larger inner volume.

In other embodiments, combining FIGS. 15 to 18, an inner wall surface of the recess 14 is adapted to an outer wall surface of the keel 3, i.e., the recess 14 can be matched and adjusted according to various shapes of the keel 3, which may be square, round, oval, trapezoidal, etc., without specific limitation.

Figure 27:
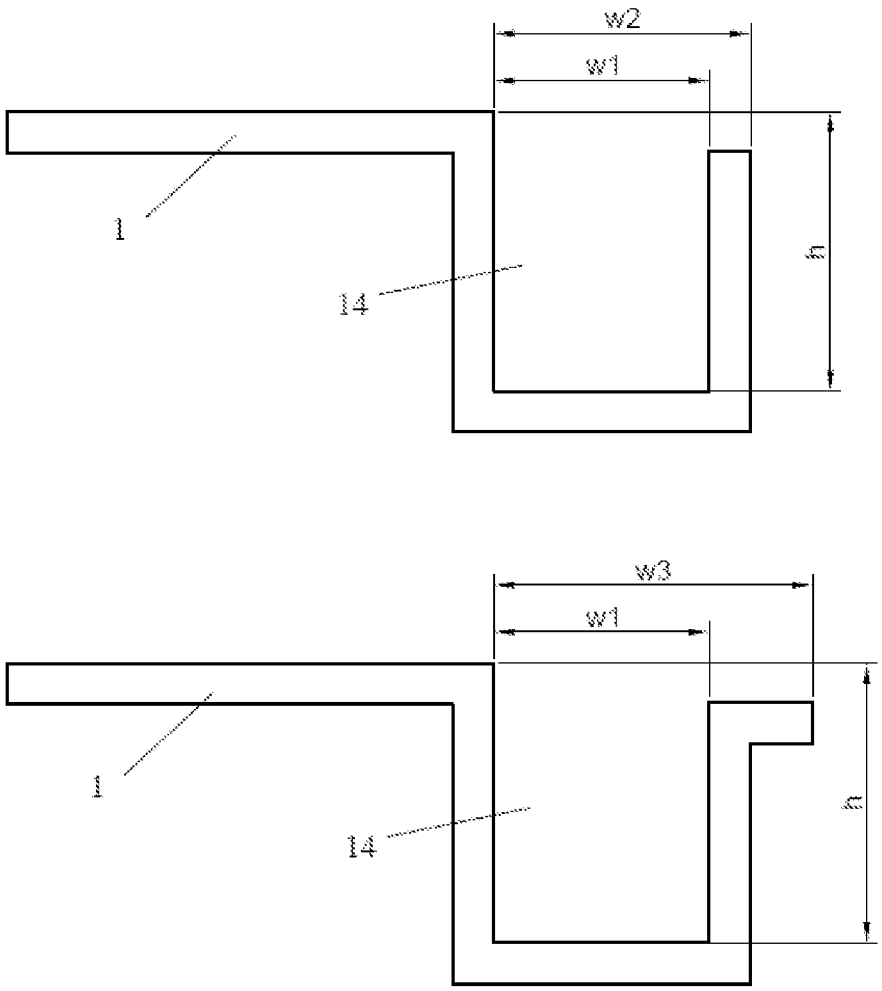
FIG. 27 shows schematic views of dimensions of recesses according to different embodiments of the present disclosure.

In some embodiments, the recess 14 is disposed close to the opening of the housing, and the position of the recess 14 may be shown in FIGS. 19 to 23. The provision of the recess 14 may enhance the strength of the opening of the case body 1, and the connection of the keel 3 and the recess 14 may further enhance the strength of the case body 1, thereby mitigating a problem of a weak strength of the case body due to the fact that the existing zipper case has a straight-sided surface near the opening. In some embodiments, as shown in FIG. 27, the dimensions of the recess 14 range from: w1: 0.3-35 mm; w2: 0.5-40 mm; w3: 1.0-40 mm; h: 0.3-35 mm.

On the basis of the above embodiments, in some embodiments, an end of the zipper fabric 2 is arranged with first zipper teeth 21, and the other end of the zipper fabric 2 is arranged with second zipper teeth 22; the first zipper teeth 21 are exposed from the case body 1 and configured to be engaged with the first zipper teeth 21 of the other zipper body; the second zipper teeth 22 are configured to be engaged with third zipper teeth 131 on a lining fabric 13 inside the case body 1. In some embodiments, the zipper fabric 2 is integrally molded with the keel 3 so as to coincide with any curvature on the recess 14, and the length of the keel 3 can be arbitrarily determined as desired.

Figure 24:
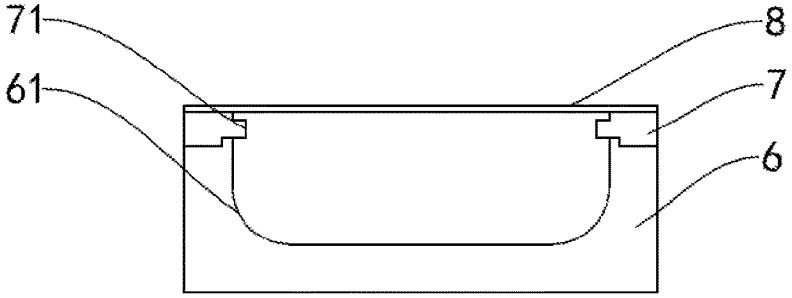
FIG. 24 is a structural schematic view of a mold according to some embodiments of the present disclosure.
Figure 25:
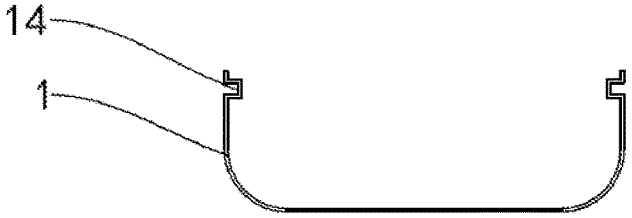
FIG. 25 is a structural schematic view of a case body according to some embodiments of the present disclosure.

Combined with FIGS. 24 and 25, the present disclosure further provides a mold including a mold body 6 and movable members 7; the mold body 6 is arranged with a first molding portion 61, and each movable member 7 is arranged with a second molding portion 71. The movable members 7 are disposed along a periphery of the first molding portion 61, a heated sheet 8 is attracted by a vacuum so as to attract the sheet 8 to form a housing on a surface of the first molding portion 61, and a recess 14 is defined by means of the second molding portion 71; the housing herein is a housing as described in the above embodiments. Exemplarily, the second molding portion 71 protrudes outwardly. During a process where the housing is detached from the mold, the movable member 7 moves outwardly first so as to facilitate the release of the housing from the mold.

Specifically, an operation method of the mold includes the following steps.

(1) gathering four the movable members 7 disposed around an upper part of the mold body 6 in a horizontal direction towards a center;

(2) placing the heated plastic sheet 8 on the mold body 6;

(3) attracting the plastic sheet 8 by vacuum, such that the sheet 8 is attracted downwardly on the first molding portion 61 of the mold body 6 to form a body of the housing; and defining the recess 14 on the second molding portions 71 of the movable members 7;

(4) during a demolding process, moving the movable members 7 outwardly in the horizontal direction away from the center to complete the demolding of the recess 14; and sinking the mold body 6 downwardly to separate the housing from the mold body 6 to realize the demolding of the housing;

(5) removing the housing to complete the mold release.

The movable member 7 as well as the mold body 6 are reset and the above process can be repeated to achieve mass production. It is to be noted that the molding as well as demolding process can be applicable to female-mold blister molding and male-mold blister molding. When it is applied to male-mold blister molding, the second molding portion 71 of the movable member 7 can be recessed. The above is only illustrative and the present disclosure is not limited thereto.

Figure 26:
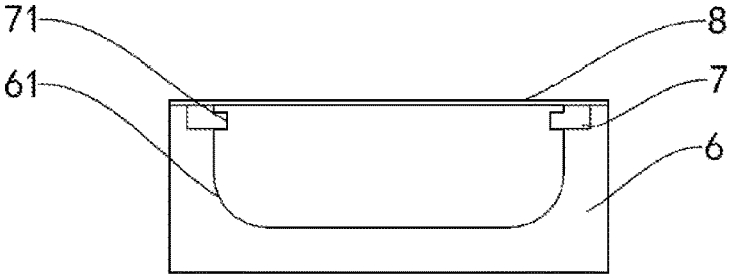
FIG. 26 is a structural schematic view of a mold according to other embodiments of the present disclosure.

In other embodiments, referring to FIG. 26, an assembly slot is defined on the mold body 6 for adapting the movable members 7, and the process of molding and demolding includes the following steps.

(1) placing the four movable members 7 into the assembly slots around the upper part of the mold body 6;

(2) placing the heated plastic sheet 8 on the mold body 6;

(3) attracting the plastic sheet 8 by vacuum, such that the sheet 8 is attracted downwardly on the first molding portion 61 of the mold body 6 to form the body of the housing; and defining the recess 14 on the second molding portions 71 of the movable members 7;

(4) during a demolding process, simultaneously releasing the movable members 7 upwardly along with the housing to separate from the mold body 6; moving the movable members 7 out in a lateral direction to complete the demolding of the recess 14. The above processes can be repeated to realize mass production.

The above is only some embodiments of the present disclosure, and the scope of the present disclosure is not limited to the above embodiments. All technical solutions belonging to the ideas of the present disclosure are within the scope of the present disclosure.

What is claimed is:

1. A zipper structure for connecting an upper housing and a lower housing of a case body; wherein the zipper structure comprises two zipper bodies, each zipper body comprising a zipper fabric and a keel; an end of the zipper fabric is arranged with first zipper teeth, and the other end of the zipper fabric is configured to be connected to a lining fabric of the case body;

the first zipper teeth of one of the two zipper bodies are configured to be engaged with the first zipper teeth of the other of the two zipper bodies;

the keel is connected to the zipper fabric; each zipper body is fixed to the case body by fixedly connecting the keel to the case body.

2. The zipper structure according to claim 1, wherein the other end of the zipper fabric, that is opposite to the end with the first zipper teeth, is arranged with second zipper teeth to be engaged with the lining fabric, and the keel is arranged between the first zipper teeth and the second zipper teeth.

3. The zipper structure according to claim 1, wherein the zipper fabric comprises two portions, and the keel is configured to connect the two portions; an end of the two portions away from keel is arranged with the first zipper teeth.

4. The zipper structure according to claim 1, wherein the keel and the zipper fabric are in a one-piece structure; or, the keel is fixed to the fabric through a lathe stitching or an adhesive.

5. The zipper structure according to claim 1, wherein the keel is of a one-piece hollow type.

6. The zipper structure according to claim 1, wherein the keel is a segmented keel comprising a plurality of segments, in a chain shape, a snap shape, or a pleated shape.

7. The zipper structure according to claim 1, wherein the keel is configured to be arranged on an outer periphery of the case body and is fixed to the case body by means of a fastener or an adhesive.

8. The zipper structure according to claim 1, wherein the zipper fabric has elasticity.

9. A case body, comprising two housings and the zipper structure of claim 1; wherein for each of the two keels:

the keel is fixedly connected to a corresponding zipper fabric; and the corresponding zipper fabric is arranged on a corresponding housing;

the corresponding zipper fabric is arranged with first zipper teeth, for controlling an opening and closing of the corresponding housing;

the corresponding housing defines a recess for accommodating the keel;

the keel is fixed within the recess for fixing the corresponding zipper fabric to the corresponding housing.

10. The case body according to claim 9, wherein a decorative strip is arranged at an opening of the recess to cover the keel, and an outer peripheral surface of the decorative strip is flush with an outer surface of the case body.

11. The case body according to claim 10, wherein the decorative strip is arranged with a first snap portion and the keel is arranged with a second snap portion; the decorative strip is fastened by snapping the first snap portion to the second snap portion.

12. The case body according to claim 9, wherein the keel is fixed to the recess by means of an adhesive or a fastener.

13. The case body according to claim 9, wherein the keel is made of plastic, soft rubber, wood, metal, or leather.

14. The case body according to claim 9, wherein an inner wall surface of the recess is adapted to an outer wall surface of the keel.

15. The case body according to claim 9, wherein an end of the corresponding zipper fabric is arranged with the first zipper teeth, and the other end of the corresponding zipper fabric is arranged with second zipper teeth; the first zipper teeth are exposed from the case body and configured to be engaged with the first zipper teeth on the other of the two zipper fabrics; the second zipper teeth are configured to be engaged with third zipper teeth on a lining fabric inside the case body.

* * * * *